United States Patent [19]

Strickland

[11] 3,964,186

[45] June 22, 1976

[54] POWERED DRAPERY TABLE

[76] Inventor: Robert V. Strickland, 9021 Wedd, Overland Park, Kans. 66212

[22] Filed: June 27, 1975

[21] Appl. No.: 591,142

[52] U.S. Cl. ..... 38/102.1

[51] Int. Cl.[2] ..... D06C 3/08

[58] Field of Search ..... 112/3 R, 3 A; 223/28, 223/51, 52, 61, 69, 70; 26/51; 38/102–102.91; 33/1 R, 2 H; 214/1 R, 1 L, 1 F, 1.1; 254/1, 51, 68, 69, 105, 106; 160/371, 378, 382

[56] References Cited

UNITED STATES PATENTS

| | | | |
|---|---|---|---|
| 2,759,273 | 8/1956 | Boyes | 38/102.1 X |
| 2,825,997 | 3/1958 | Piper et al. | 38/102.1 |

*Primary Examiner*—G. V. Larkin

*Attorney, Agent, or Firm*—John A. Hamilton

[57] ABSTRACT

A drapery table having a clamp bar extending the width thereof and supported thereon parallel to the forward table edge, or to a reference line of the table, clamp devices for securing one edge of a large sheet of fabric to the clamp bar, and a power device for moving said bar laterally to draw said fabric sheet across the table, so as to insure that the line of the fabric at the table edge, or at the reference line, is precisely parallel to the clamped fabric edge. Devices are provided for automatically stopping the bar at the limits of its travel, for adjusting the limits at which bar travel is stopped, for adjusting the bar into precise parallelism with the table edge, or the reference line thereof, and providing for allowing individual application of the clamp devices, but for simultaneous release of all of the clamp devices from a single station.

15 Claims, 11 Drawing Figures

POWERED DRAPERY TABLE

This invention relates to new and useful improvements in drapery tables of the class in which one edge of a large sheet of drapery fabric may be clamped accurately to a clamp bar movable transversely of itself over a planar supporting table surface, whereby the fabric is drawn across said table in smooth flat condition with full assurance that any line of the fabric drawn to a reference line of the table, such as an edge of the table or an index line imprinted on the table surface, will be accurately parallel to its clamped edge. In use, one edge of a drapery, usually either its top or bottom edge, is cut, hemmed, or otherwise treated, then clamped to the clamp bar, and the clamp bar is then moved transversely of itself to draw the sheet across the table until the desired drapery height, with allowances for hemming or the like, exists between the bar and a reference line of the table parallel to said bar. The opposite edge of the drapery sheet may then be marked, cut, hemmed or the like along said reference line with full assurance that said opposite edge will be truly parallel with its clamped edge. The difficulties of handling very large sheets of fabric in these circumstances by any manual means are well known. In draperies, the edge to be cut or hemmed may be 32 feet long or even longer.

A principal object of the present invention is the provision of a drapery table of the general character described providing power-operated means for moving the clamp bar over the table surface. This does much to reduce the often very substantial physical effort required to move the bar when a large sheet of drapery fabric is clamped thereto.

Another object is the provision of a drapery table of the character described having a power drive unit at each end of the clamp bar, and means operable to insure fully synchronized operation of the drive units, whereby to insure that each position of the bar will be accurately parallel to all other positions.

A further object is the provision of a drapery table of the character described including limit controls whereby movement of the clamp bar may be halted accurately at any pre-determined points, whereby to facilitate the handling of a plurality of draperies of the same height, as well as halted by manually operable means at any other points.

A still further object is the provision of operating drapery table of the character described, the power engine elements of which are readily detachable from the table itself, and may be sold separately for attachment to pre-existing manually operated tables.

Other objects are simplicity and economy of construction, and efficiency and dependability of operation.

Figure 1:
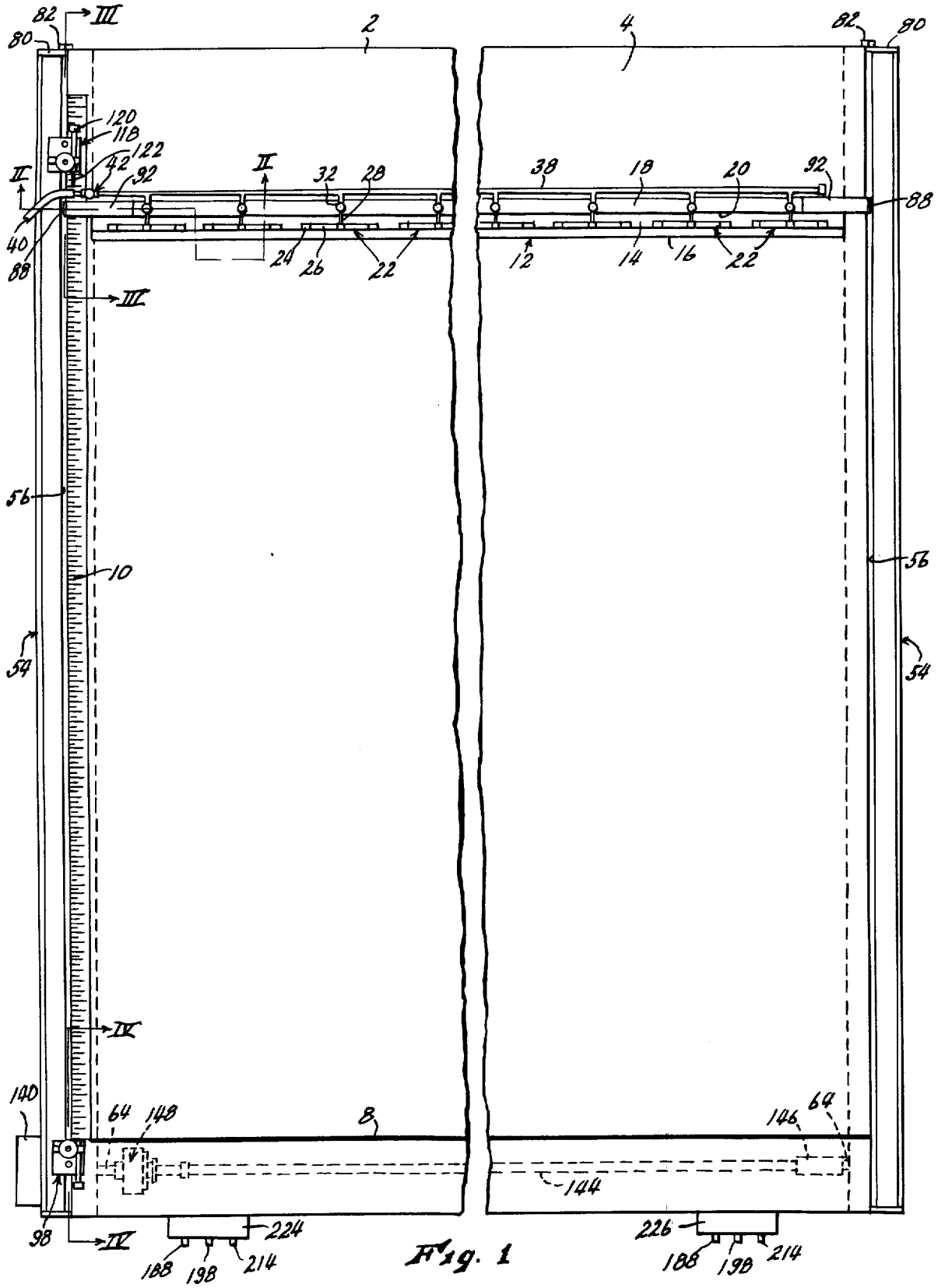
Figure 2:
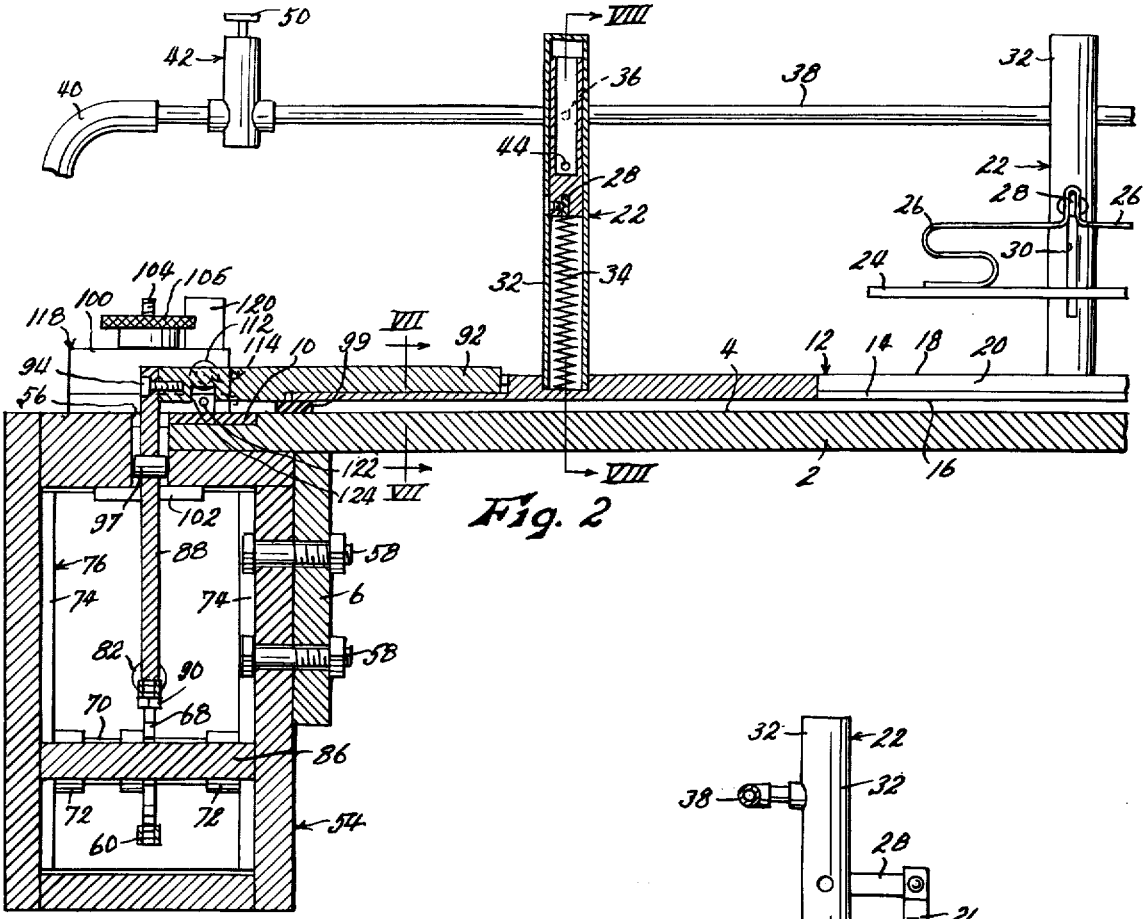
Figure 3:
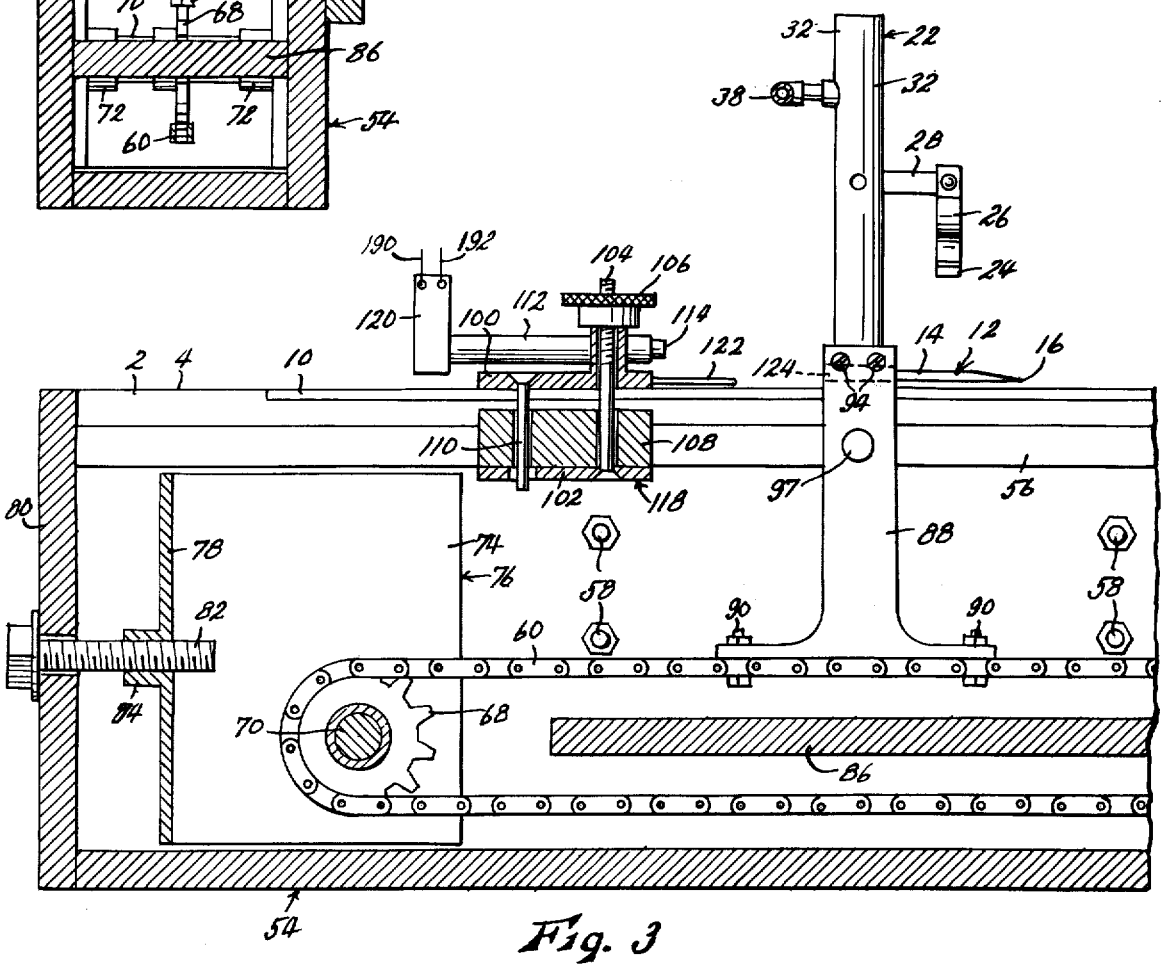
Figure 6:
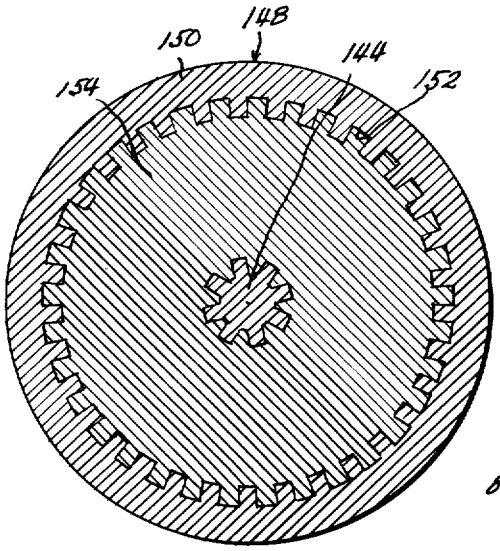
Figure 4:
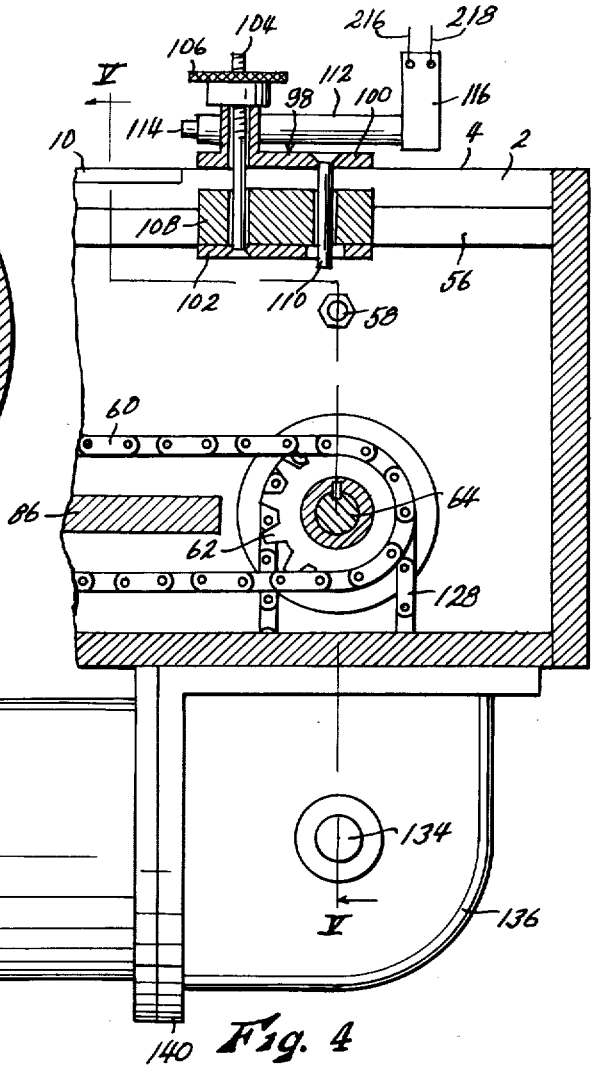
Figure 5:
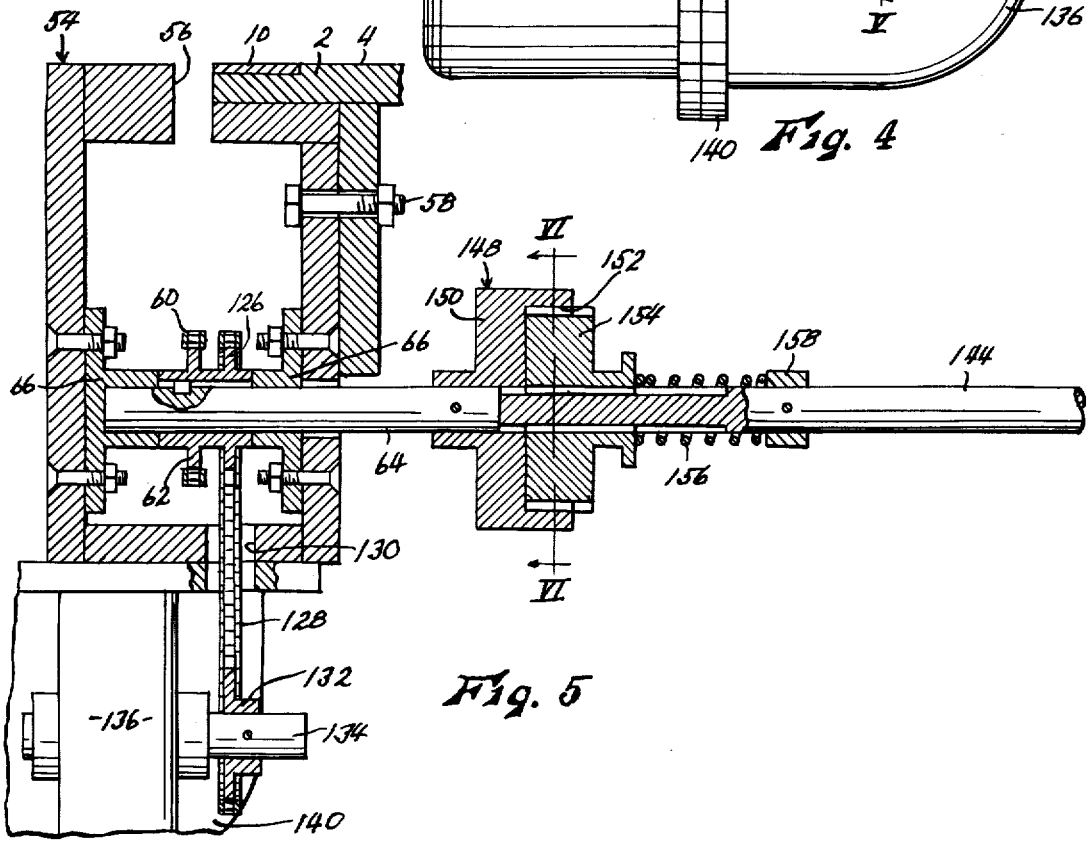
Figure 7:
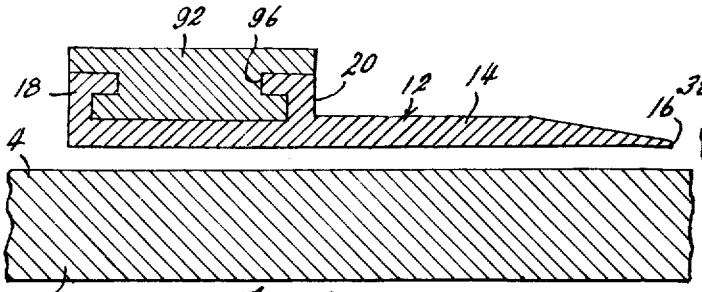
Figure 11:
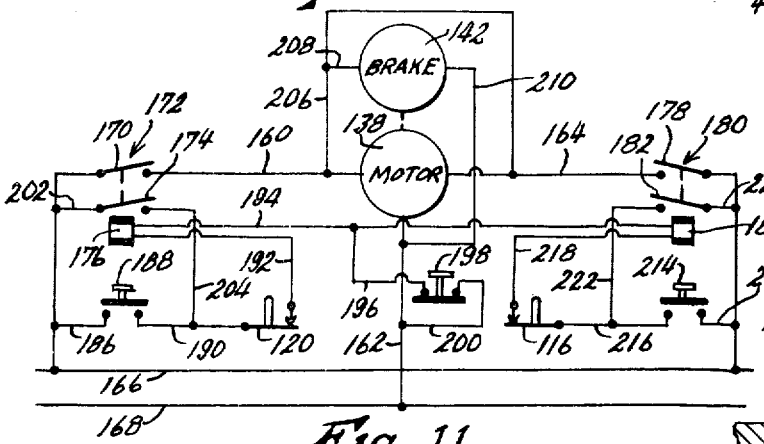
Figure 8:
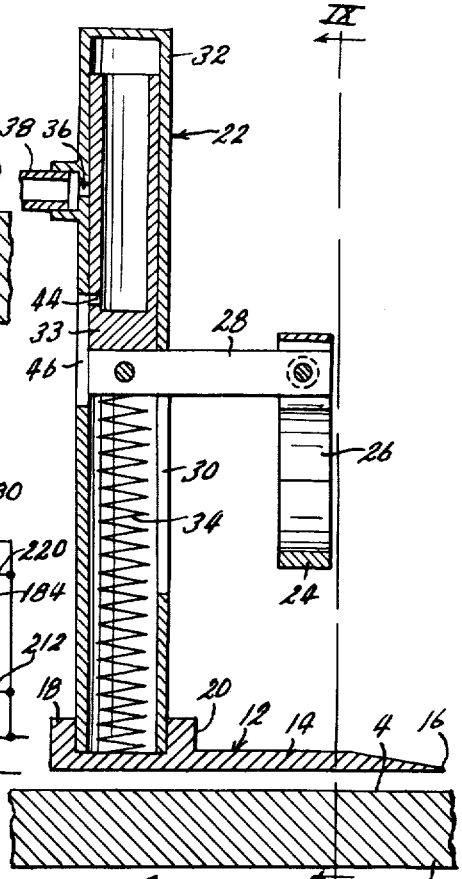
Figure 9:
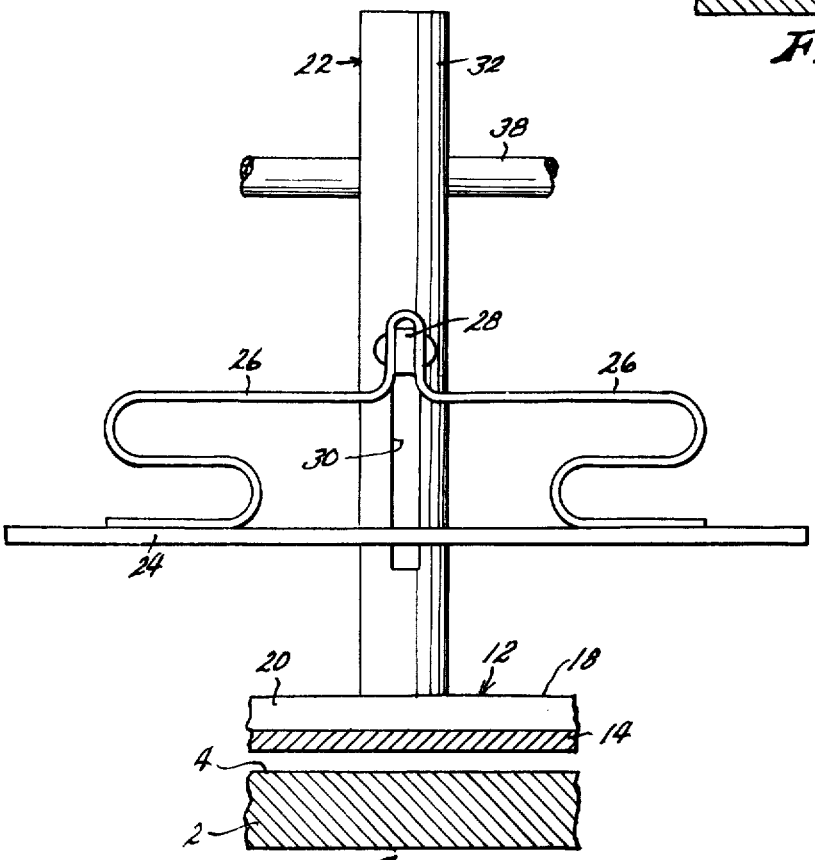
Figure 10:
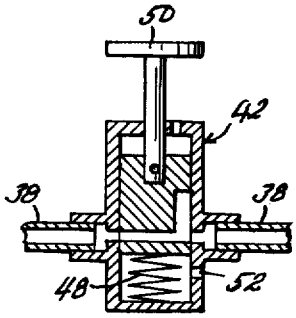

With these objects in view, as well as other objects which will appear in the course of the specification, reference will be had to the accompanying drawing, wherein:

FIG. 1 is a top plan view, partially broken away and foreshortened, of a drapery table embodying the present invention, FIG. 2 is an enlarged, fragmentary sectional view taken on line II—II of FIG. 1, FIG. 3 is an enlarged, fragmentary sectional view taken on line III—III of FIG. 1, FIG. 4 is an enlarged, fragmentary sectional view taken on line IV—IV of FIG. 1, FIG. 5 is a fragmentary sectional view taken on line V—V of FIG. 4, FIG. 6 is an enlarged sectional view taken on line VI—VI of FIG. 5, FIG. 7 is an enlarged, fragmentary sectional view taken on line VII—VII of FIG. 2, FIG. 8 is an enlarged, fragmentary sectional view taken on line VIII—VIII of FIG. 2, FIG. 9 is a fragmentary sectional view taken on line IX—IX of FIG. 8, FIG. 10 is an enlarged sectional view of the clamp bar release valve, and FIG. 11 is a schematic diagram of the electrical control system of the device.

Like reference numerals apply to similar parts throughout the several views, and the numeral 2 applies to the table top slab, consisting of a rectangular horizontal board, the top surface 4 of which a drapery sheet, not shown, is to be drawn over by the clamp bar to be described. The front to rear dimension of the table (vertical in FIG. 1) is commonly about 10 feet, while the width may be as desired, widths up to 32 feet not being unusual. The top slab 2 of the table is usually attached to underlying frame boards 6 (see FIG. 2) for reinforcement, and is supported at any desired height above the floor by suitable table legs, not shown. Adjacent the forward edge of the table top, and parallel thereto, a reference line, or "zero line" 8 is imprinted on the table surface. A measuring rule 10, usually calibrated in inches, is set flush into the table edge, extending along the left side edge thereof as shown, the zero point of its scale being set at zero line 8.

Extending laterally across the table, in parallel relation to the front edge of the table and to zero line 8, is an elongated clamp bar indicated generally by the numeral 12. Said bar is generally flat, its forward edge portion 14 being relatively thin, with its extreme forward edge portion being tapered to a sharp edge as indicated at 16, and its rearward edge portion 18 being vertically thickened, whereby to form a forwardly facing vertical shoulder 20 at the rearward edge of portion 14. Shoulder 20 is straight the full length of the bar. One edge of a sheet of drapery fabric (not shown) is positioned against shoulder 20, and the fabric clamped against the top surface of bar section 14 by clamps to be described. The top surface of bar section 14 may be roughened to resist slippage of fabric clamped thereagainst.

The clamp bar 12 carries a continuous series of clamps, each indicated generally by the numeral 22, in regularly spaced relation therealong. Said clamps are of the type shown in my prior U.S. Pat. No. 3,861,663, issued Jan. 21, 1975, and reference may be had to said patent for a detailed description of their operation. Generally, however, each clamp consists of a foot bar 24 extending parallel to bar 12 above section 14 thereof, and connected by vertically yieldable spring arms 26 to the forward end of an arm 28 which extends horizontally rearwardly through a vertically elongated slot 30 in a hollow vertical post 32 which constitutes a pneumatic cylinder, closed at its upper end and fixed at its lower end in the thickened rearward edge portion 18 of clamp bar 12. Within post 32, arm 28 is affixed to a piston 33 operably slidable in said post, and normally held in its elevated position by a spring 34, with foot bar 24 spaced above the clamp bar. Compressed air is delivered to each post 32, through a port 36 thereof, from an air pipe 38 similarly connected to all of the posts. Pipe 38 extends horizontally behind the posts and is affixed thereto, being connected to a flexible air hose 40 through a release valve 42 to be described. As seen in FIG. 8, piston 33 normally obstructs port 36 so as to remain elevated, any air leaking past the piston being vented to the atmosphere through an opening 44 of the piston and a slot 46 of the post wall. However, when the operator manually positions the drapery fabric under foot bar 24 of a clamp, and manually depresses the foot bar against spring 34 to a certain degree, piston 33 uncovers port 36, so that the downward stroke of the piston is completed by air pressure to clamp the fabric between foot bar 24 and section 14 of the clamp bar. When the piston uncovers port 36, piston opening 44 has moved below post slot 46, and the upper end of the post is sealed against the escape of air. As shown in FIG. 10, release valve 42 has a normal position, to which it is biased by a spring 48, in which it delivers air from hose 40 to pipe 38. It is provided with a pushbutton 50 which, when depressed, seals off hose 40 and vents pipe 38 to the atmosphere through vent opening 52. Thus, while all of clamps 22 may be applied individually, as is desirable when clamping the drapery fabric to the clamp bar, they may all be released simultaneously by pressing pushbutton 50 momentarily.

Arranged along each side of the table is an elongated narrow, hollow box 54 formed of any suitable rigid material. Said box extends the full length of the table side, and is provided with a full length slot 56 in its top wall. Said box is rigidly but detachably connected to the table itself in any suitable manner, for example by bolts 58 extending through a frame board 6 of the table and the abutting side wall of the box, as best shown in FIG. 2. It is desired that the top surface of the box be flush with the top surface of table slab 2. Thus, if slab 2 extends outwardly from the frame board, as shown, the top wall of the box at the inner side of slot 56 is set lower than at the outer side of the slot, by an amount equal to the thickness of the slab. If the frame board is set at the extreme edge of the table slab, the top of the box may be planar, and set flush with the top surface of the table slab.

Carried within each of boxes 54 is an elongated endless loop 60 of sprocket chain extending substantially the full length of the box. At its forward end, said chain loop is trained about a sprocket 62 fixed on a transverse shaft 64 journalled in bearings 66 fixed to the side walls of the box, said shaft extending outwardly from the box, toward the other of said boxes, and coaxially with shaft 64 of said other box. At its rearward end, said chain loop is trained about a sprocket 68 fixed on a transverse shaft 70 journalled in bearings 72 fixed in the confronting walls 74 of a U-shaped bracket 76 which fills and is longitudinally slidable in the box. The connecting portion 78 of said bracket (see FIG. 3) is spaced inwardly from the rear end wall 80 of said box, and a screw 82 rotatably based in said end wall extends longitudinally of the box and is threaded into a bushing 84 fixed in said bracket connecting portion. Thus, by tightening or loosening screws 82, the tension of chains 60 may be adjusted, or more importantly, equalized with each other.

Any possible interference between the upper and lower reaches of chains 60 is prevented by a horizontal partition wall 86 of the box, said partition wall of course terminating short of front and rear sprockets 62 and 68. The upper reach of each chain loop is directly beneath and parallel to the slot 56 in the top of its box, and a vertical post 88, which may be termed a drive member, is affixed at its lower end to said upper chain reach, as by bolts 90 extending through links of the chain. Said post extends upwardly through slot 56, and a bar 92 is affixed to the upper end of said post, above the box, as by screws 94. Bars 92 extend horizontally over the table, and each is attached to the adjacent end of clamp bar 12 in any suitable manner, such as by the sliding dovetail connection 98 to the thickened rear edge portion 18 of the clamp bar illustrated in FIG. 7. A bearing member 97, formed of nylon or the like, is fixed in the post at the vertical elevation of slot 56 to provide a smooth sliding support for the post. A block 99 of nylon or the like is fixed to the lower surface of bar 92, and rides on the top surface of the table, thereby supporting the clamp bar, or much of it, out of contact with the table, in order to ease its movement over the table.

A front limit switch carrier 99 is mounted in slot 56 of one of boxes 54 (the left as shown), forwardly of the clamp bar. As best shown in FIG. 4, said carrier includes a top plate 100 overlying the box slot, a bottom plate 102 underlying said slot within the box, a screw 104 fixed in the bottom plate and extending upwardly through the slot and top plate, and a clamp nut 106 threaded on said bolt above the top plate. By loosening said nut, the carrier may be moved freely along slot 56, and by tightening said nut, the carrier is clamped in position. A block 108 carried slidably in slot 56, and pierced by bolt 104 and by a pin 110 fixed in the top plate and extending through the bottom plate, prevents the carrier from turning about a vertical axis when nut 106 is loosened. Top plate 100 has affixed therein a plunger tube 112 which extends parallel to slot 56, and from the rearward end of which extends a spring loaded plunger 114. At the forward end of tube 112 is mounted a normally closed micro-switch 116, which it will be understood is opened by depression of plunger 114. Thus whenever clamp bar 12 is moved forwardly by the power means to be described, and mounting bar 92 of said clamp bar engages and depresses plunger 114, the opening of switch 116 shuts off the power means, also as will be described.

A rear limit switch carrier 118 is mounted in slot 56 of the left box 54 rearwardly of the clamp bar. Carrier 118 is generally similar to carrier 98, corresponding parts being indicated by corresponding numerals, except that plunger 114 thereof projects forwardly, and that its normally closed micro-switch, which is designated by the numeral 120, is operable by depression of its plunger 114 to interrupt the rearward travel of the clamp bar, as will be described. This plunger is engaged by the rearward edge of bar 92 as the clamp bar moves rearwardly. It would of course be possible to set carrier 118 so that the reading of rule 10 as indicated by the reference shoulder 20 of the clamp bar equals the desired spacing of shoulder 20 from zero line 8 of the table. However, most operators prefer a direct reading, and for this reason a forwardly projecting finger 122 is fixed in top plate 100 of carrier 118, so as to directly overlie rule 10. A transverse groove 124 is provided in the lower surface of bar 92 (see FIG. 2) which accomodates finger 122 as bar 92 approaches carrier 118. Thus, if properly set, bar 92 will contact plunger 114, and open switch 120, when the forward end of finger 122 coincides with shoulder 20 of the clamp bar.

Fixed on the forward sprocket shaft 64 of one of boxes 54, the left as shown, is a second sprocket 126 disposed within the box. Sprocket 126 has a sprocket chain 128 trained thereabout. Chain 128 extends doenwardly through a hole 130 formed therefor in the floor of the box (see FIG. 5) and is trained about a sprocket 132 fixed on the output shaft 134 of a geared speed reducer 136 driven by a reversible electric motor 138. Reducer 136 and motor 138 are mounted on a bracket 140 fixed to the associated box 54 by any suitable means, not shown. It will be seen in FIG. 11 that motor 138 is equipped with an electric brake device 142 operable to resist rotation of said motor. That is, said brake is automatically applied by spring means, not shown but well understood in the art, whenever said device is not electrically energized, but is released whenever said device is electrically energized. Motors so equipped with spring-applied, electrically-released brakes are common and well known in the art.

The front sprocket shafts 64 of the left and right boxes 54 are joined by a connector shaft 144 (see FIG. 1) extending transversely of the table beneath the forward portion thereof, coaxially with shafts 64, the length of which is of course determined by the width of the table. Shaft 144 is connected to the right shaft 64 by a coupling 146, which may be of any ordinary non-adjustable type, and to the left shaft 64 by an adjustable coupling 148. As shown in FIGS. 5 and 6, coupling 148 includes a hub member 150 fixed on shaft 64 and providing an internally toothed socket 152 coaxial with the shafts and opening toward shaft 144. The mating end of shaft 144 is journalled rotatably in hub 150, and is longitudinally splined, having mounted thereon an internally splined, externally toothed plunger 154. Said plunger is longitudinally slidable on shaft 144, but cannot rotate relative thereto, and its external teeth can engage in the internal teeth of hub 150 selectively at any of a large member of different relative angular positions of the hub and plunger. The plunger is biased toward engagement in hub socket 152 by a compression spring 156 bearing at one end against said plunger and at its opposite end against a collar 158 fixed on shaft 144, but can be manually retracted against said spring to disengage it from said socket, to permit relative angular adjustment of shafts 64 and 144.

FIG. 11 shows a schematic wiring diagram of the motor control system. It will be understood that motor 138 is of a type which will turn in a direction to move clamp bar 12 rearwardly over the table when supplied with electric current across wires 160 and 162, and will turn in a reverse direction to move clamp bar 12 forwardly over the table when supplied with electric current across wires 164 and 162. The electric supply line wires are shown at 166 and 168. Motor lead 160 is connected to line wire 166 through one pole 170 of a normally open, double-pole relay 172, the other pole being indicated at 174, said relay being closed by energization of its coil 176. Motor lead 164 is connected to line wire 166 through one pole 178 of a second normally open, double pole relay 180 having a second pole 182, and adapted to be closed by energization of its coil 184. Motor lead 162 is connected to line wire 168. A starting circuit for rearward motion of the clamp bar is provided from line wire 166 through wires 160 and 186, a normally open push-button switch 188, wire 190, normally closed rear limit switch 120, wire 192, relay coil 176, wires 194 and 196, a normally closed pushbutton switch 198, and wires 200 and 162 to line wire 168. Thus whenever pushbutton 188 is momentarily closed, relay coil 176 is energized to close the circuit of motor 138 across wires 160 and 162, and said motor causes clamp bar 12 to start rearwardly. Closure of pole 174 of relay 172 establishes a holding circuit from line wire 166 through wires 160 and 202, relay pole 174, wires 204 and 190, limit switch 120, wire 192, coil 176, wires 194 and 196, switch 198, and wires 200 and 162 to line wire 168, so that coil 176 remains energized even after pushbutton 188 is released, and motor 138 remains in operation, moving clamp bar 12 rearwardly, until limit switch 120 is opened by the arrival of the clamp bar at its pre-set rearmost position as determined by the placement of carrier 118 of said limit switch, or until pushbutton "stop" switch 198 is momentarily pressed to open it. The opening of either of switches 120 or 198 interrupts the holding circuit, allowing relay 172 to open to interrupt the motor circuit. Whenever relay pole 170 closes to supply current to the motor, it also supplies current from wire 160 through wires 206 and 208, brake device 142 and wires 210 and 162 to line wire 168. Brake device 142, thus energized, releases its braking action on the rotation of the motor. Whenever the motor circuit is interrupted, the circuit of the brake device is also interrupted, and it functions to bring the motor to an abrupt halt.

Similarly, a starting circuit for causing rotation of motor 138 in a reverse direction to move clamp 12 forwardly is provided from line wire 166, through wires 164 and 212, a normally open pushbutton switch 214, wire 216, front limit switch 116, wire 218, coil 184 of relay 180, wires 194 and 196, pushbutton switch 198, and wires 200 and 162 to line wire 168. A holding circuit is provided from line wire 166 through wires 164 and 220, pole 182 of relay 180, wires 222 and 216, limit switch 116, wire 218, coil 184, wires 194 and 196, pushbutton 198 and wires 200 and 162 to line wire 168. Lead wire 206 of brake device 142 is also connected to motor lead 164.

Rearward "start" switch 188, forward "start" switch 214 and "stop" switch 198, as well as relays 172 and 180, may be mounted in a control box 224 mounted at the forward edge of the table, as indicated in FIG. 1, or at any other desired location. Any number of additional control boxes, illustrated by the single additional box 226 shown in FIG. 1, may be provided, in order to control the clamp bar movement from any desired number of stations. Each additional control box need include only switches 188, 198 and 214, wired in parallel with the corresponding switches of master control box 224.

To install the device, boxes 54 are affixed to the side edges of table 2 by bolts 58 as shown. It will be readily apparent that with very minor adaptations, said boxes may be applied to any pre-existing drapery table. In some cases, as when the table is very wide, it may be necessary or desirable to install a third similar box midway between the two shown, in order that clamp bar 12 may be supported and driven at its midpoint as well as at its ends, to avoid bowing of said clamp bar in the plane of table top. In such cases, the slot 56 of any such intermediate box would in effect "cut the table slab 2 in half", and therefore when any intermediate box is used, slab 2 must be reinforced by braces extending transversely beneath said intermediate box. Bars 92 are then slipped onto the ends of the clamp bar, and affixed to chain posts 88 by screws 94. The sliding nature of the dovetail connection 96 between bars 92 and clamp bar 12 compensates for any small lack of parallelism between the side edges of the table, so that clamp bar 12 exerts no lateral force on posts 88, and cannot be bowed vertically if posts 88 should move closer together due to said lack of parallelism. The necessary electrical and pneumatic connections are then made, hose 40 connecting any suitable source of air under pressure to pipe 38, and control box 224, as well as any "satellite" control boxes 226 desired, are attached to the table or elsewhere, as deemed most convenient to the operator. Chains 60 are then tensioned equally by operation of screws 82.

Then, by pressing "forward" button 214, clamp bar 12 is moved forwardly by operation of motor 138 until the forward edge 16 of said clamp bar overlies zero line 8 imprinted on the table surface, and any lack of parallelism therebetween is visually observed. If they are not precisely parallel, coupling 148 is disengaged by manually retracting plunger 154 thereof from socket 152, turning left shaft 64 and connector shaft 144 independently of each other until bar edge 16 is precisely parallel to line 8, and then re-engaging the coupling. The fineness of this adjustment is limited only by the number of teeth in the mating coupling elements. Both this adjustment, and also the equal tensioning of chains 60, are necessary if clamp bar 12 is to remain accurately parallel to line 8 at all positions of its movement.

In use, the operator first sets carrier 118 of rear limit switch 120 in slot 56 of left box 54, at such a position that the end of finger 122 overlies the mark of rule 10 having the desired spacing from zero line 8 of the table, and sets carrier 98 of front limit switch 112 far enough rearwardly that said switch will stop forward movement of clamp bar 12 before posts 88 of chains 60 engage front sprockets 62. He then presses "forward" button 214 to move the clamp bar sufficiently close to the forward edge of the table that he can conveniently reach it, not necessarily to zero line 8. If there is a particular forward position of the clamp bar at which he finds it easiest to connect drapery fabric thereto, he can set the forward limit switch at this position, whereupon said limit switch will stop the clamp bar at this position automatically each time it is moved forwardly.

The drapery fabric is usually contained initially in a canvas sling, not shown, extending transversely of the table beneath its forward edge, in order to keep it out of contact with the floor. The operator grasps one end of a previously cut or hemmed edge of the fabric, and secures it against the top of section 14 of the clamp bar, by means of either endmost clamp 22 of the clamp bar, as previously described, taking care that the fabric edge closely engages shoulder 20 of the clamp bar. The remaining clamps 22 are then secured in like manner, consecutively along the length of the clamp bar, until the entire length of the fabric edge is secured. The clamped fabric edge, if engaging shoulder 20 of the clamp bar, will then be both straight, and accurately parallel to zero line 8 of the table. The operator then presses "rear" button 188 momentarily to initiate rearward movement of the clamp bar, whereupon the fabric is drawn smoothly and tautly over the table top, and this movement continues until the clamped edge of the fabric, at shoulder 20, coincides with the free end of finger 122, at which time limit switch 120 is opened to shut motor 138 off, and the fabric comes to rest with the pre-set spacing between its clamped edge and the line thereof then overlying zero line 8. The fabric may then be marked, cut or otherwise treated along the line thereof overlying zero line 8, with every assurance that this line of the fabric is accurately parallel to its clamped edge. Of course, the operator could use the forward edge of the table slab 2 itself as a reference line along which to cut or mark the fabric if desired, but most operators prefer to work to a zero line printed on the table somewhat rearwardly of its forward edge, as shown. The operator can interrupt the travel of clamp bar 12 at any time by pressing "stop" button 198, and this is often desirable in order to give the operator time to rearrange the fabric or to smooth wrinkles or folds therefrom.

Motor brake 142 is of considerable importance. Without it, the motor would have a considerable degree of overtravel, or "coasting" after its operating circuit was interrupted, with the result that the fabric edge fastened to the clamp bar would not be accurately aligned with the free end of finger 122 when the system comes to rest. Since accuracy is very important in drapery work, this would necessitate a tedious process of manually pressing buttons 188 and 214 alternately to "hunt" and find the desired alignment. The brake 142 eliminates any appreciable overtravel of the motor, and hence solves the problem.

While I have shown and described a specific embodiment of my invention, it will be readily apparent that many minor changes of structure and operation could be made without departing from the spirit of the invention.

What I claim as new and desire to protect by Letters Patent is:

1. A drapery table comprising:

a. a rectangular planar table top having front, rear and side edges, b. a straight clamp bar extending across said table top at right angles to its side edges, c. a series of clamp devices carried by said clamp bar at intervals along its length, and operable to secure an edge of a sheet of drapery fabric to said clamp bar, d. a pair of drive units carried respectively at the opposite side edges of said table top and each including a drive member movable in a direction parallel to the associated side table edge, e. power means operable to move said drive members selectively and concurrently in either direction in their lines of travel, and f. a connector joining each of said drive members to the adjacent end of said clamp bar, whereby said drive units move said clamp bar transversely of itself.

2. A drapery table as recited in claim 1 wherein each of said connectors is freely slidable relative to said clamp bar in a direction longitudinal to said clamp bar, whereby to compensate for any lack of parallelism between the paths of movement of said drive members.

3. A drapery table as recited in claim 1 wherein said power means comprises:

a. a reversible electric motor, b. a power train connecting said motor operatively and directly to one of said drive members, c. a connector joining said one drive member to the other of said drive members, whereby said other drive member is driven at a speed equal to that of said one drive member, and d. a disengageable coupling interposed in said connector, whereby when said coupling is disengaged, said drive members may be moved to different relative positions in their lines of travel.

4. A drapery table as recited in claim 1 wherein said power means comprises:

a. a reversible electric motor operable by rotation thereof in opposite directions to move said drive members in respectively opposite directions, b. a pair of electric motor operating circuits operable when energized to cause rotation of said motor in respectively opposite directions, each of said operating circuits including a source of electric power, said motor, and a normally open first relay, said relay having a coil operable by energization thereof to close said relay, c. a holding circuit associated with each of said operating circuits and including a source of electric power, said relay coil, and a normally open second relay also operable to be closed by energization of said relay coil, and d. a starting circuit associated with each of said operating circuits and including a source of electric power, said relay coil, and a normally open, momentary-closure switch.

5. A drapery table as recited in claim 4 with the addition of a pair of normally closed limit switches carried by said table and each operable to be opened by said clamp bar as said bar approaches the respectively opposite limits of its travel, each of said limit switches being connected in series in the holding and starting circuits of the motor operating circuit which is operable when energized to cause rotation of said motor to move said clamp bar toward that limit swtich.

6. A drapery table as recited in claim 4 wherein said limit switches are adjustably movable on said table in a direction parallel to the direction of movement of said clamp bar, whereby the limits of travel of said clamp bar may be adjusted.

7. A drapery table as recited in claim 4 wherein both of said holding circuits include a conductor common to both, and with the addition of a normally closed, momentary-open switch connected in series in said common conductor.

8. Drapery table as recited in claim 4 with the addition of a brake normally applied to resist rotation of said motor, and electrical means operable when energized to disengage said brake, said brake release means being connected in parallel with both of said motor operating circuits.

9. A drapery table as recited in claim 1 wherein said power means includes an electric motor operable when energized to move said drive members, and with the addition of a brake normally resisting operation of said motor, and electric release means operable when energized to release said brake, said release means being connected in parallel with said motor in the operating circuit of said motor.

10. A drapery table as recited in claim 1 wherein each of said drive units includes an endless sprocket chain arranged in an elongated loop extending parallel to the associated side table edge, and front and rear sprockets about which said chain loop is trained, the associated drive member being affixed to one reach of said chain, said power means being operable to turn one sprocket of each of said drive units.

11. A drapery table as recited in claim 10 including means whereby one of the sprockets of each of said drive units may be moved in a direction parallel to the associated chain loop, where by the tension of said chain loops may be equalized.

12. A drapery table as recited in claim 10 wherein said power means comprises:

a. an electric motor operable when energized to turn one of the sprockets of one of said drive units, and b. a connector shaft interconnecting said one sprocket to the corresponding sprocket of the other drive unit, said sprockets being of equal diameter whereby both of said sprocket chains are driven at equal linear speeds.

13. A drapery table as recited in claim 12 with the addition of a disengageable coupling interposed in said connector shaft, whereby when said coupling is disengaged, the sprockets connected by said shaft may be turned independently of each other.

14. A drapery table as recited in claim 10 wherein each drive unit includes an elongated box extending parallel to the associated side table edge, and being disposed with its top surface flush with the table top, and having a slot formed longitudinally in the top wall thereof, the associated sprocket chain and sprockets being mounted within said box, and the associated drive member constituting a post affixed at its lower end to said chain and extending upwardly through said slot, said box being detachably mounted on said table, whereby said drive units may be applied to pre-existing drapery tables.

15. A drapery table as recited in claim 14 wherein said power means constitutes an electric motor mounted on one of said boxes and operable to drive one of the chain sprockets carried by that box, and a connector shaft connecting said one sprocket to the corresponding sprocket of the other of said boxes, said connector shaft extending transversely of said table therebeneath.

* * * * *